US006968669B2

(12) United States Patent
Schroeder et al.

(10) Patent No.: US 6,968,669 B2
(45) Date of Patent: Nov. 29, 2005

(54) FLEXIBLE PACKAGING

(75) Inventors: Alfred A. Schroeder, San Antonio, TX (US); Robert S. Bosko, San Antonio, TX (US)

(73) Assignee: Lancer Partnership Ltd., San Antonio, TX (US)

( * ) Notice: Subject to any disclaimer, the term of this patent is extended or adjusted under 35 U.S.C. 154(b) by 0 days.

(21) Appl. No.: 10/288,988

(22) Filed: Nov. 6, 2002

(65) Prior Publication Data

US 2004/0083684 A1 May 6, 2004

(51) Int. Cl.[7] ..... B65B 61/00
(52) U.S. Cl. ..... 53/410; 53/133.2; 493/87
(58) Field of Search ..... 53/410, 450, 451, 53/133.2, 416; 493/87

(56) References Cited

U.S. PATENT DOCUMENTS

| | | | | |
|---|---|---|---|---|
| 3,894,381 | A | | 7/1975 | Christine |
| 4,055,032 | A | | 10/1977 | Hammond |
| 4,246,062 | A | | 1/1981 | Christine |
| 4,341,522 | A | | 7/1982 | Gaubert |
| 4,381,846 | A | | 5/1983 | Heck |
| 4,411,359 | A | | 10/1983 | Franco |
| 4,491,247 | A | | 1/1985 | Nitchman et al. |
| 4,512,136 | A | | 4/1985 | Christine |
| 4,524,458 | A | | 6/1985 | Pongrass et al. |
| 4,566,250 | A | | 1/1986 | Matsumura |
| 4,568,321 | A | | 2/1986 | Gaubert |
| 4,598,524 | A | | 7/1986 | Cheng |
| 4,601,410 | A | | 7/1986 | Bond |
| 4,603,536 | A | | 8/1986 | de la Poype |
| 4,633,649 | A | * | 1/1987 | Gautier et al. ..... 53/413 |
| 4,695,337 | A | | 9/1987 | Christine |
| 4,709,528 | A | | 12/1987 | Merkus |
| 4,710,157 | A | | 12/1987 | Posey |
| 4,718,215 | A | | 1/1988 | Carveth |
| 4,726,171 | A | | 2/1988 | Kreager et al. |
| 4,779,397 | A | | 10/1988 | Christine |
| 4,893,731 | A | | 1/1990 | Richter |
| 4,913,316 | A | | 4/1990 | Richter |
| 4,924,655 | A | | 5/1990 | Posey |
| 4,998,990 | A | | 3/1991 | Richter |
| 5,139,168 | A | | 8/1992 | Gueret |
| 5,147,071 | A | | 9/1992 | Rutter |
| 5,203,819 | A | | 4/1993 | Gleason |
| 5,254,074 | A | | 10/1993 | Landers |
| 5,334,180 | A | | 8/1994 | Adolf |
| 5,348,525 | A | | 9/1994 | Buchanan |
| 5,467,581 | A | | 11/1995 | Everette |
| 5,477,883 | A | | 12/1995 | Totten |
| 5,493,845 | A | | 2/1996 | Adolf |
| 5,514,123 | A | | 5/1996 | Adolf |
| 5,564,591 | A | | 10/1996 | Christine et al. |
| 5,566,851 | A | | 10/1996 | Sasaki et al. |
| 5,647,511 | A | | 7/1997 | Bond |
| 5,743,435 | A | | 4/1998 | Tomic |
| 5,749,493 | A | | 5/1998 | Boone |
| 5,788,620 | A | | 8/1998 | Aeschbach |

(Continued)

FOREIGN PATENT DOCUMENTS

DE 19714057 A1 10/1998

(Continued)

*Primary Examiner*—John Paradiso

(57) ABSTRACT

Methods and apparatus for forming and filling a flexible package are provided in which cross seals are made substantially parallel to a central axis (60) of fitments (40). The cross seals (68, 82) are substantially parallel to the vertical plane that includes the central axis (60) of the fitment (40), and may comprise at least a section angled toward the fitment (66, 84, 86) to create an angled side.

19 Claims, 4 Drawing Sheets

U.S. PATENT DOCUMENTS

| | | | | |
|---|---|---|---|---|
| 5,827,164 | A | 10/1998 | Tomic | |
| 5,832,698 | A | 11/1998 | Huguenin | |
| 5,915,596 | A | 6/1999 | Credle, Jr. | |
| 5,937,617 | A | 8/1999 | Yeager | |
| 5,941,421 | A | 8/1999 | Overman | |
| 6,027,438 | A | 2/2000 | Frazier | |
| 6,041,575 | A | 3/2000 | Vonderhorst et al. | |
| 6,045,006 | A | 4/2000 | Frazier | |
| 6,066,081 | A | 5/2000 | Bachner | |
| 6,073,807 | A | 6/2000 | Wilford | |
| 6,076,664 | A | 6/2000 | Yeager | |
| 6,102,252 | A | 8/2000 | Overman | |
| 6,179,173 | B1 | 1/2001 | Frazier | |
| 6,205,746 | B1 | 3/2001 | Moss | |
| 6,253,994 | B1 | 7/2001 | Mogard | |
| 6,354,062 | B1 | 3/2002 | Haughton et al. | |
| 6,591,874 | B2 | 7/2003 | Credle, Jr. | |
| 6,609,636 | B1 | 8/2003 | Petriekis et al. | |
| 2002/0112451 | A1 * | 8/2002 | Pritchard | 53/451 |
| 2002/0148857 | A1 | 10/2002 | Savage | |
| 2002/0170272 | A1 * | 11/2002 | Cooper et al. | 53/450 |
| 2004/0083685 | A1 * | 5/2004 | Knoerzer et al. | 53/412 |

FOREIGN PATENT DOCUMENTS

| | | | |
|---|---|---|---|
| EP | 0156627 | A2 | 10/1985 |
| EP | 0251812 | A2 | 7/1989 |
| EP | 0278670 | A2 | 8/1989 |
| EP | 0 216 800 | B1 | 7/1990 |
| EP | 0377 882 | A1 | 7/1990 |
| EP | 0589575 | A1 | 3/1994 |
| EP | 0 596 142 | B1 | 5/1994 |
| EP | 0 663 880 | B1 | 7/1995 |
| EP | 0 688 291 | B1 | 12/1995 |
| EP | 0 710 176 | B1 | 5/1996 |
| EP | 0 713 468 | B1 | 5/1996 |
| EP | 0 729 406 | B1 | 9/1996 |
| EP | 0778217 | A1 | 6/1997 |
| EP | 0695698 | B1 | 10/1997 |
| EP | 1086804 | A2 | 3/2001 |
| EP | 1 094 970 | B1 | 5/2001 |
| GB | 2293134 | A | 3/1996 |
| GB | 2 303 116 | B | 2/1997 |
| GB | 2 320 481 | B | 12/2000 |
| GB | 2 331 065 | B | 1/2002 |
| JP | 9-267849 | | 10/1997 |
| WO | WO 98/22350 | A1 | 5/1998 |
| WO | WO 99/41155 | A1 | 8/1999 |
| WO | WO 00/23377 | A1 | 4/2000 |
| WO | WO 00/68087 | A1 | 11/2000 |
| WO | WO 01/39967 | A1 | 6/2001 |
| WO | WO 01/79073 | A1 | 10/2001 |
| WO | WO 02/40353 | A1 | 5/2002 |

* cited by examiner

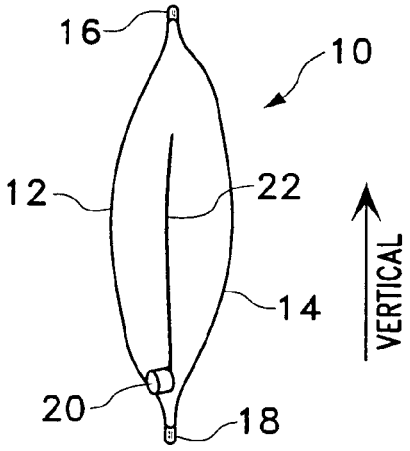
FIG. 1A
(PRIOR ART)
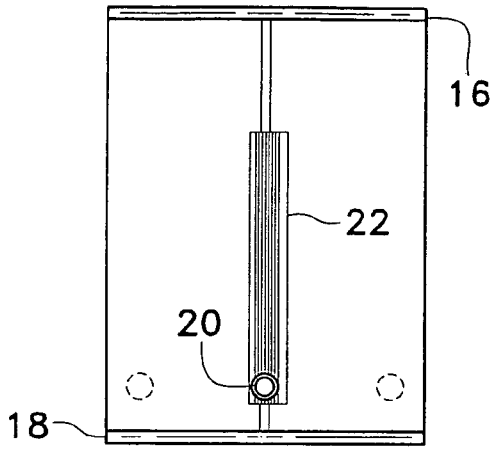
FIG. 1B
(PRIOR ART)
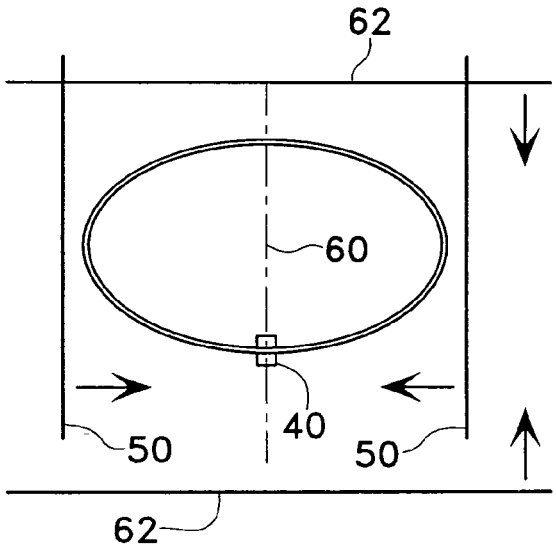
FIG. 3
FIG. 4
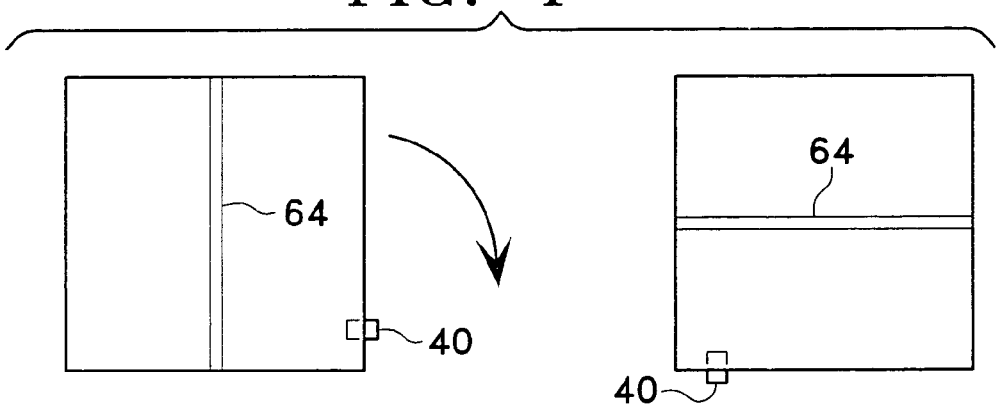

FLEXIBLE PACKAGING

TECHNICAL FIELD OF THE INVENTION

This invention relates generally to packaging, and more particularly to flexible packaging.

BACKGROUND OF THE INVENTION

The many advantages of flexible packaging have made it the package of choice in many applications. Two prominent fields for flexible packaging are the beverage industry, for example for wines or for beverage syrups, and the pharmaceutical field. Of course, many other applications exist as well.

In general, products are filled into flexible packages and then distributed for use by customers for their particular application. The products are either filled into pre-made bags through fitments, or filled into bags as the bags are being made on form, fill, and seal machines. Often the flexible packaging is distributed in boxes, and such systems are commonly referred to as bag-in-box ("BIB") systems. "Bag," as used in this disclosure, is meant to include any flexible package, including, without limitation, bags, pouches, and stand-up packages.

FIGS. 1A and 1B illustrate certain prior art bags and some of the problems associated with them. FIG. 1A shows a side view of a bag 10 that includes opposing side walls 12 and 14, and cross seams 16 and 18. Fitment 20 is used to evacuate the bag, and is formed on or through bag wall 12. As shown in FIG. 1B, the fitment 20 may be located in many places across the bag, but cannot be placed all the way to the bottom of the bag, because of the need for space for forming cross seal 18.

As seen in FIGS. 1A and 1B, the fitment 20 opens (inside the bag) in close proximity to the bag wall 14, thus creating a high likelihood of inefficient evacuation, since bag wall 14 may close off flow through fitment 20 by sealing against the inside of the fitment 20. To solve this problem, evacuation devices such as dipstrip 22 or fitments with standoffs, have been used to prevent such sealing off.

Even with evacuation assist devices, in use, as shown by the use-orientation of FIG. 1, the fitment 20 opens horizontally, and thus, as the bag collapses during evacuation, there can be an undesirable amount of unevacuated remnant. Moreover, turning the spout downward, with the bag remaining vertically oriented as shown in FIG. 1 generally exacerbates the problem of evacuation, rather than helping it. Finally, turning the whole bag face down, so that the fitment 20 evacuates downward, does not solve the evacuation problem, because much of the contents of the bag will be horizontally displaced from the spout and will very likely not evacuate.

Therefore, a need as arisen for methods and apparatus that eliminate or substantially reduce problems associated with prior art systems.

SUMMARY OF THE INVENTION

In accordance with the teachings of the present invention, methods and apparatus for forming and filling flexible packages are provided which substantially eliminate or reduce problems associated with prior art systems.

In a particular embodiment, a method of forming and filling a flexible package is provided that comprises attaching a fitment to a sheet of flexible material, overlapping two of the sides of the sheet, vertically sealing at least part of the overlapped material, forming a seal substantially parallel to the central axis of the fitment, filling the package, and sealing the package. In particular embodiments, the fitment is attached before or after overlapping. Also in another particular embodiment, an evacuation device is attached proximate the fitment.

Also provided is a method of forming and filling a flexible package that comprises attaching a fitment to a sheet of flexible material, partially forming the package, forming a seal substantially parallel to the vertical plane that includes the central axis of the fitment, the seal comprising at least a section angled toward the fitment to create an angled side, filling the package, and sealing the package.

In particular embodiments, the fitment is attached before or after partially forming the package. Also in a particular embodiment, an evacuation device is attached proximate the fitment. In another particular embodiment, the top seal comprises at least a section angled toward the fitment to create another angled side.

Also provided is a method of forming and filling flexible packages that comprises forming a substantially hollow structure from a sheet of flexible material, attaching a first fitment to the sheet of flexible material, attaching a second fitment to the sheet of flexible material horizontally and vertically spaced apart from the first fitment, the first and second fitments having substantially parallel central axes, forming a first seal substantially parallel to the vertical plane that includes the central axes, the first seal comprising a section angled with respect to horizontal to create a first angled side, filling above the first seal, and forming a second seal substantially parallel to the vertical plane that includes the central axes, the second seal comprising a section angled with respect to horizontal to create a second angled side. In particular embodiments, one or both of the fitments are attached before or after forming the substantially hollow structure. Also in another particular embodiment, evacuation devices may be attached proximate the fitments.

Also provided is a method of retrofitting an existing machine, which comprises rotating cross sealing members.

Also provided is a method of using a package made according to the present invention, wherein the fitment is attached from a side orientation, and the package is then rotated during use so that the fitment faces downward for efficient evacuation.

Also provided are apparatus for creating packages and carrying out the methods of the present invention. Furthermore, apparatus and methods are provided for pre-made packages, wherein the packages are sealed first, then filled through the fitment, and the fitment is then capped or otherwise sealed.

An important technical advantage of the present invention is that flexible packages are created that have improved evacuation.

BRIEF DESCRIPTION OF THE DRAWINGS

Reference is made in the description to the following briefly described drawings, wherein like reference numerals refer to corresponding elements:

FIGS. 1A and 1B illustrate prior art flexible packages;

FIG. 3 illustrates a schematic of seal and fitment orientations according to the teaching of the present invention;

FIG. 4 illustrates bag manufacturing and use orientations according to the teachings of the present invention;

DETAILED DESCRIPTION OF THE INVENTION

Figure 2:
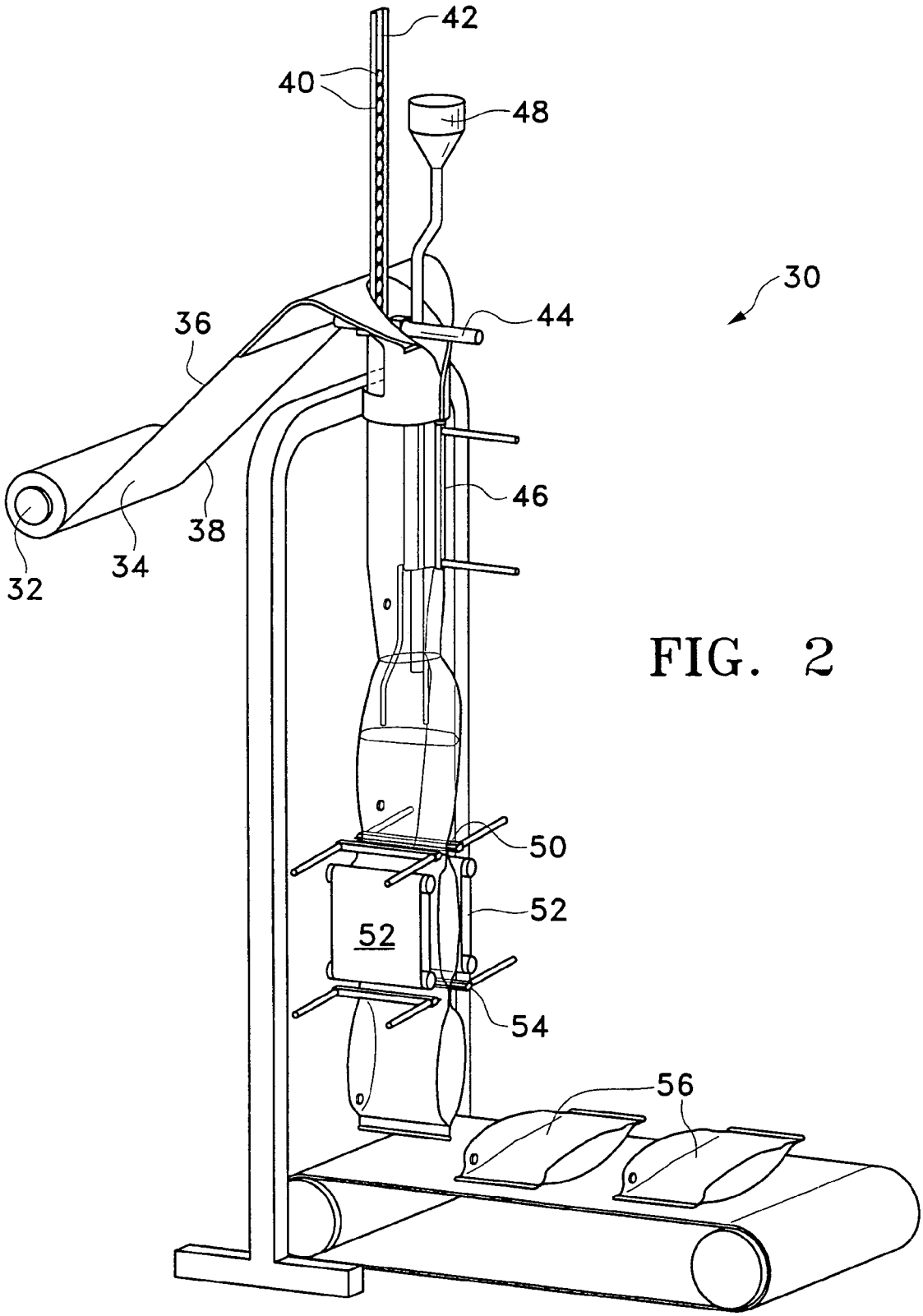
FIG. 2 illustrates a particular embodiment of a particular form, fill, and seal machine according to the teachings of the present invention.

FIG. 2 illustrates a particular embodiment of a machine for making bags according to the teachings of the present invention. Although the present invention is described in connection with the vertical form, fill, and seal machine of FIG. 2, it should be understood that it applies as well to horizontal machines, and to systems and machines that use pre-made bags that are filled and evacuated through a fitment. In such pre-made systems, the packages are made and then filled through the fitments, which are then capped or otherwise sealed.

As shown in FIG. 2, a roll 32 of flexible material 34 is provided. The sheet of flexible material 34 includes sides 36 and 38. The sheet 34 is rolled over a collar to form a tubular structure. Within this description, tube, or tubular, is meant to indicate a shape that has open top and open bottom and need not have a round or oval cross-sectional shape. Indeed any cross-sectional shape may be used.

Fitments 40 are fed along a guide rail or track 42 and are attached to the flexible material 34 with a sealer 44. This fitment attachment can be accomplished in any known way, and fitments may comprise internal fitments or pass-through fitments. For pass-through fitments, a hole can be punched before inserting the fitment, or the hole may be created during the fitment attachment process.

A heat-sealing bar 46 is used to seal the bag material 34 near or at its ends 36 and 38 after they are overlapped, to vertically seal the tubular structure, thus creating a partially formed bag that is opened at the top and the bottom. The overlapping seal discussed herein is important for relatively large bags, to prevent the contents from leaking through the seal (in contrast to the relatively weaker seals that can be made where two ends are brought together face to face for sealing). With relatively large systems, for example, without limitation, those that can make bags holding a gallon or more of contents, this overlapping seal becomes important. In systems that make smaller bags, it is often difficult to accommodate the overlapping seal, since the back member against which the seal presses may not fit within the tube. However, with relatively larger systems, such as that disclosed herein, there is room to accommodate this vertical sealing. Nonetheless, the overlapping seal may be used with relatively smaller systems, and the present invention is not limited to systems that include overlapping seals.

Contents of the bag are filled through a filler 48, that includes a fill pipe extending into the tube for filling the bags. This occurs after a bottom seal is formed by a heat-sealer 50. Heat sealer forms a cross seal that is parallel to the central axis of the fitment 40. With existing systems that make bags such as that shown in FIG. 1, the cross seals are perpendicular to the central axis of the fitment. Thus, an important technical advantage of the present invention is the orientation of the cross seals. In one aspect of the present invention, existing machines are retrofitted by rotating the cross sealing members approximately 90 degrees. With this invention, significant modifications to the machines need not be made.

A pair of roller guides 52 support and shape the bags during filling and top sealing and allow most of the air to be expelled from the bag before sealing. The seal bar 50 also forms the top seal of each bag. A cutter 54 is used to cut the bags free for distribution, such as, without limitation, as part of a BIB system.

As shown, by rotating the sealing members as discussed above, the fitments 40 are located at the side of the bags. FIG. 3 illustrates, schematically, this rotation. As shown, sealing is accomplished with sealing members 50 sealing parallel to the central axis 60 of fitment 40. Although the opposing sealing bars 50 are shown as each moving inwardly, it should be understood that one may be a stationary backing, and the other may move to seal against the stationary backing, or vice versa. Some prior art systems use sealing members such as sealing members 62 shown in FIG. 3, which seal perpendicular to the central axis 60 of fitment 40. By sealing substantially parallel to the central axis of the fitment, evacuation is greatly assisted because the fitment (sometimes referred to as a spout) opens into the bag substantially parallel to the cross seals, and not against opposing bag walls, as happens with the prior art such as shown in FIG. 1A.

Referring now to FIG. 4, a bag made according to the teachings of the present invention is oriented with the fitment 40 on the side during manufacturing, but at the bottom during use. Thus, the bag is rotated 90 degrees from its manufacturing orientation for use. FIG. 4 shows the seal 64 made by vertical sealer 46.

FIGS. 5–8 illustrate particular embodiments of the present invention in which angled or ramped seals are made to assist in evacuation. Although the particular embodiments shown in FIGS. 5–8 are discussed in connection with a vertical form, fill, and seal machine, the concepts apply as well to other machines, including those that make pre-made bags.

Figure 5:
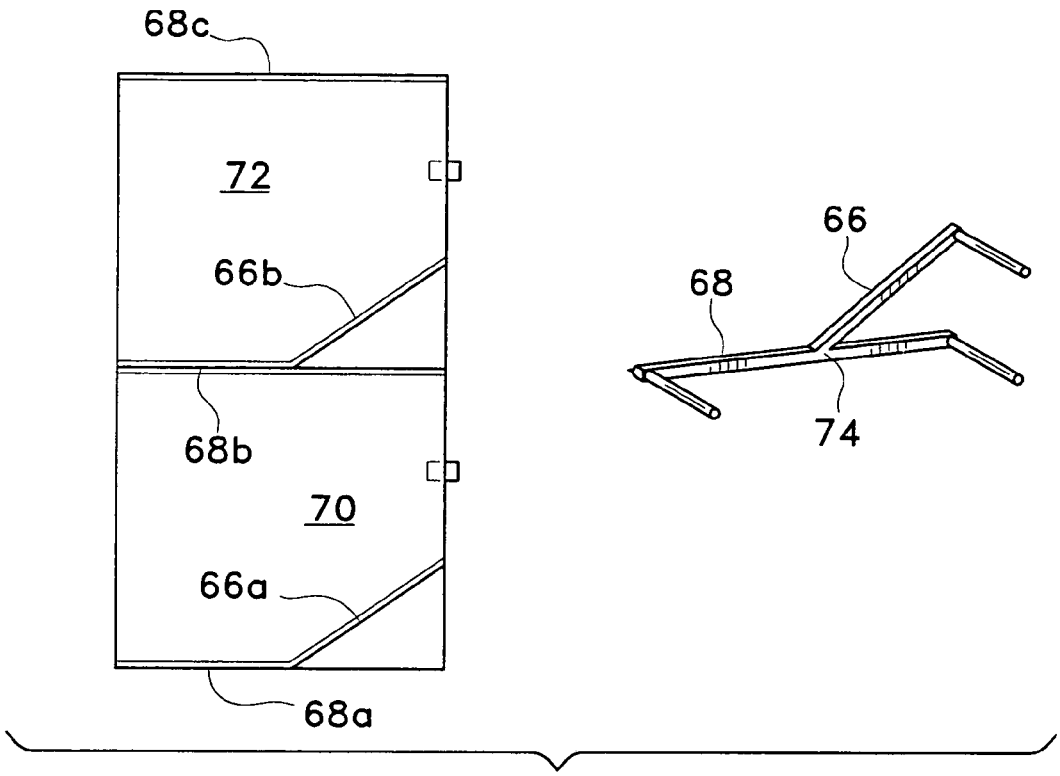
FIG. 5 illustrates a particular embodiment of a sealing profile and sealing member according to the teachings of the present invention.

As shown in FIG. 5, a ramped or angled seal 66 is formed that diverges from the straight cross-seal 68. In particular, in the embodiment of a vertical form, fill, and seal, machine, a bag 70 is first sealed at its bottom with seal 66*a* and seal 68*a* (which may be made with one or more sealers). Product is then filled into the bag 70, and the bag 70 is advanced and sealed at the top (seal 68*b*), preferably with the same sealing mechanism. As the top seal of bag 70 is made, the bottom seals 66*b* and 68*b* of bag 72 are made. Bag 72 is then filled, and advanced and sealed at its top, indicated as seal 68*c*. One embodiment of a seal mechanism for making the seals discussed in FIG. 5 is shown by reference 74 in FIG. 5. This sealing mechanism 74 corresponds to the sealing member 50 shown in FIG. 2, of course with the change that the ramp sealing section 66 is provided.

As discussed, it is preferable that one sealing mechanism be used to make the bottom seals and top seals for each bag. However, it should be understood that more than one sealing member may be used to make the appropriate seals.

In use, the separated bags of FIG. 5 are rotated as shown in FIG. 4. Thus, the fitments face downward, and the ramped or angled seals 66 help direct product toward the fitments for efficient evacuation. In general, referring to the orientation of FIG. 5, one aspect of the present invention encompasses any seals made substantially parallel to the vertical plane that includes the central axis of the fitment, when those seals are angled toward the spout to assist in evacuation when the bag is rotated for use after manufacturing.

Figure 6:
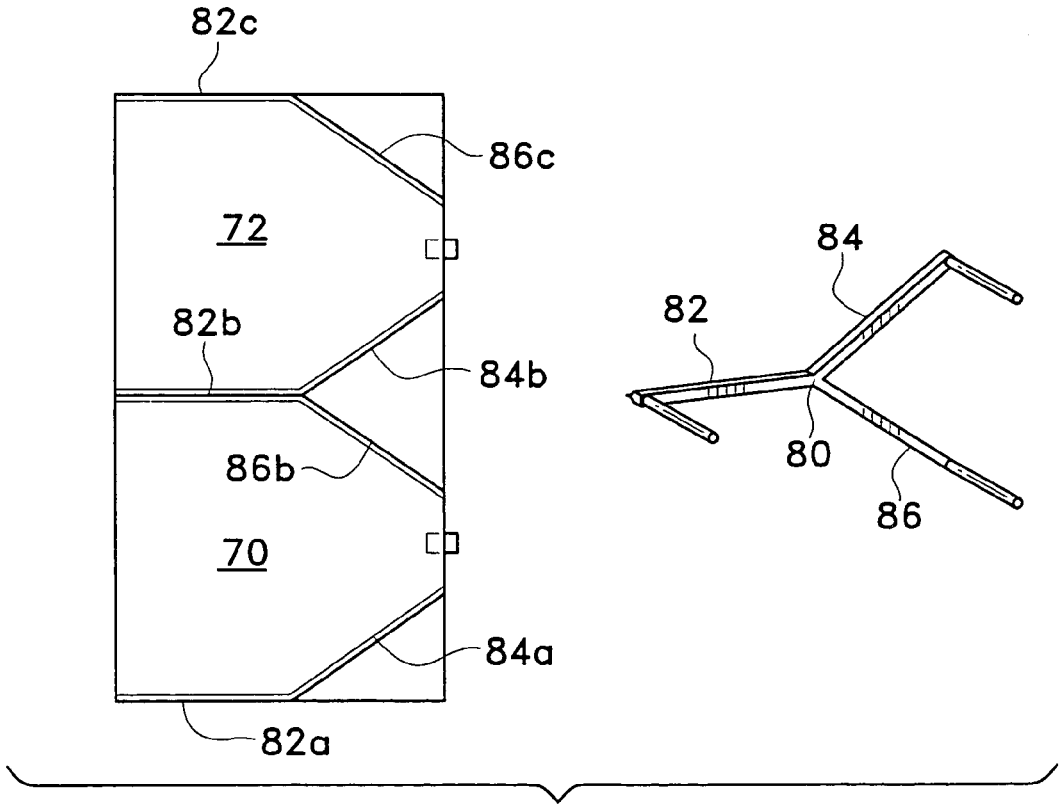
FIG. 6 illustrates another embodiment of a sealing profile and sealing member according to the teachings of the present invention.

FIG. 6 illustrates an alternative embodiment to that shown in FIG. 5 wherein a sealing member 80, corresponding to sealing member 50 of FIG. 2, is illustrated. In the embodiment of FIG. 6, a sealing member 80 includes a horizontal sealing section 82 and two angled sealing sections 84 and 86. Again, bags 70 and 72 are illustrated, with bag 70 being formed first by making its bottom seal comprising seal sections 82*a* and 84*a*. Section 84*a* is ramped toward the spout. The bag 70 is filled, and then its top seal is made, again with sealing member 80, and its top seal is indicated by sealing sections 82*b* and 86*b*. The bag 72 is then advanced and filled, with its bottom seal 82*b* and 84*b* having already been made at the same time as the top seal 82*b* and 86*b* of bag 70. After filling, the top seal of bag 72 is made, as discussed above, resulting in seal sections 82*c* and 86*c*. After the bags are separated for distribution, they are used in an orientation 90 degrees from that shown in FIG. 6, wherein the fitments (or spouts) are facing downward. Evacuation is greatly assisted by the ramp effect of seals 84 and 86, assisting in moving product toward the spout for efficient evacuation.

Figure 7:
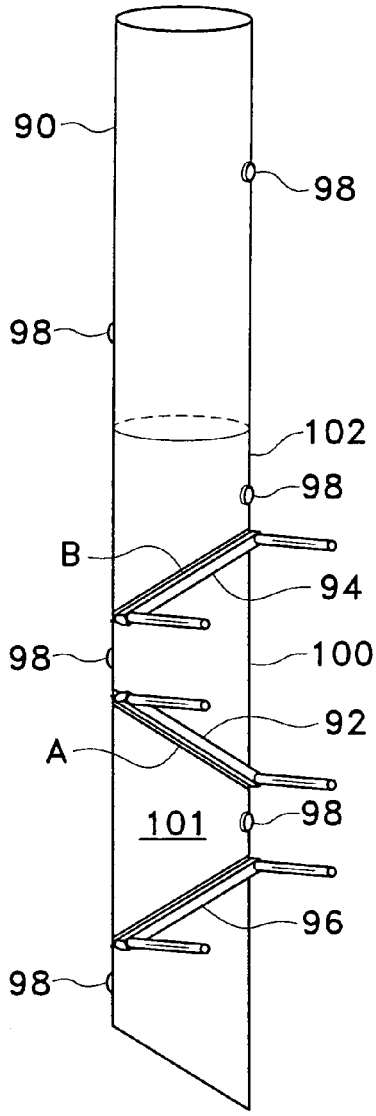
FIG. 7 illustrates another embodiment of a system for making bags according to the teachings of the present invention.
Figure 8:
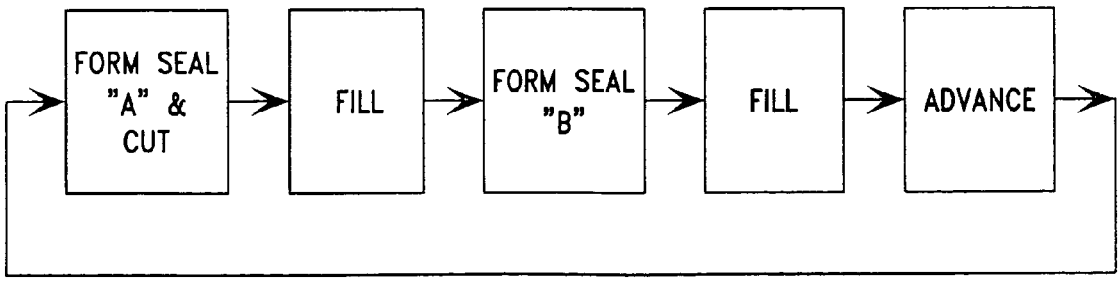
FIG. 8 illustrates a flow diagram corresponding to the apparatus of FIG. 7.

FIGS. 7 and 8 illustrate alternative embodiments to those shown in FIGS. 5 and 6, wherein, as shown in FIG. 7 a tube of bag material 90 is sealed and cut by members 92, 94, and 96. However, in the embodiment shown in FIG. 7, fitments 98 are attached to bag material 90 in alternating fashion, each one vertically and horizontally displaced (on the sheet) from the next, preferably 180 degrees on the tube from the other fitment. Thus, with reference to FIG. 2, two stations for attaching fitments are be provided, one for attaching on the bag material 90 at one location, and the second for attaching 180 degrees opposite from that location.

In operation, sealing and cutting member 92 forms a bottom seal to partially form a bag 100 (and cut the previous bag 101). Bag 100 is filled and then sealed at its top by sealing member 94. Sealing member 94 forms top seal B of bag 100, which reference B also denotes the bottom seal of bag 102. Next, bag 102 is filled and advanced so that its seal B is aligned with cutting member 96. Then, sealing member 92 forms a top seal A of bag 102 (and a cut is made along A as well). Cutting member 96 cuts along seal B and thus bag 100 and bag 102 are cut free for distribution. In a preferred embodiment, the cutting by cutter 96 and the sealing and cutting from member 92 are accomplished at the same time, however, it should be understood that they may be accomplished at other times with separate devices. Furthermore, it should be understood that the order of the filling and advancing discussed above in connection with bag 102 can be interchanged.

The embodiments shown in FIGS. 7 and 8 have the advantage of using substantially all of the bag material 90. As can be seen by the shape of the bags, they form bags that, when rotated for use so that the fitments face down, each include two ramped seals A and B that assist in moving product toward the fitments.

U.S. patent application Ser. No. 10/126,702, filed Apr. 19, 2002 and entitled Flexible Packaging, commonly assigned, is herein incorporated by reference. In particular, the teachings of that application with respect to attaching evacuation devices apply to the present invention, and thus may be combined with the present invention to create flexible packages that also include evacuation devices.

Throughout the description, it should be understood that, where appropriate, the order of the processes may be changed without departing form the intended scope of the present invention. Also, it should be understood that any fitment type can be used with each embodiment, including, without limitation, internal type fitments or pass-through type fitments.

The particular descriptions provided are illustrative examples, and features and advantages of each example may be interchanged with, or added to the features and advantages in the other embodiments and examples herein. And, in general, although the present invention has been described in detail, it should be understood that various changes, alterations, substitutions, additions and modifications can be made without departing from the intended scope of the invention, as defined in the following claims.

What is claimed is:

1. A method of forming and filling a flexible package, comprising:

attaching a fitment to a sheet of flexible material, the sheet having a first side end, a second side end, an inside surface, and an outside surface, the fitment having a tubular passageway with a central axis;

overlapping the first and second side ends such that part of the inside surface is in contact with part of the outside surface;

vertically sealing at least part of the overlapped part of the sheet;

forming a seal substantially parallel to the central axis of the tubular passageway of the fitment;

filling the package; and sealing the package.

2. The method of claim 1, wherein the flexible package is a plastic bag.

3. The method of claim 1, wherein the fitment is attached before overlapping.

4. The method of claim 1, wherein the fitment is attached after overlapping.

5. The method of claim 1, wherein sealing the package comprises making a top seal.

6. The method of claim 1, wherein forming the seal comprises forming a bottom seal.

7. The method of claim 1, wherein filling the package comprises filling the package with a liquid product, and further comprising attaching an evacuation device proximate the fitment, the evacuation device comprising a first end and a terminal end and a channel at least partially open to the liquid product between the first and terminal ends, the evacuation device extending away from the fitment and adapted to facilitate flow of the liquid product to the fitment by effectively preventing the sheet of flexible material from closing off flow to the fitment during evacuation of the package.

8. The method of claim 7, wherein the evacuation device that is attached proximate the fitment comprises a length between the first and terminal ends, and wherein the channel is at least partially open to the liquid product substantially the entire length between the first and terminal ends, and wherein the fitment is adapted to be coupled to a pump for evacuation of the liquid product.

9. A method of forming and filling a flexible package, comprising:

attaching a fitment to a sheet of flexible material, the sheet having a first side end, a second side end, an inside surface, and an outside surface, the fitment having a tubular passageway with a central axis;

overlapping the first and second side ends of the sheet such that part of the inside surface is in contact with part of the outside surface;

sealing at least part of the overlapped sheet;

forming a seal substantially parallel to the vertical plane that includes the central axis of the tubular passageway of the fitment, the seal comprising at least a section angled toward the fitment to create an angled side;

filling the package; and sealing the package.

10. The method of claim 9, wherein the flexible package is a plastic bag.

11. The method of claim 9, wherein the fitment is attached before the package is partially formed.

12. The method of claim 9, wherein the fitment is attached after the package is partially formed.

13. The method of claim 9, wherein sealing the package comprises making a top seal.

14. The method of claim 13, wherein the top seal comprises at least a section angled toward the fitment to create another angled side.

15. A method of forming and filling flexible packages, comprising:

forming a substantially hollow structure from a sheet of flexible material;

attaching a first fitment to the sheet of flexible material;

attaching a second fitment to the sheet of flexible material horizontally and vertically spaced apart from the first fitment on the sheet, the first and second fitments having substantially parallel central axes after the hollow structure is formed;

forming a first seal substantially parallel to the vertical plane that includes the central axes, the first seal comprising a section angled with respect to horizontal to create a first angled side;

filling above the first seal; and forming a second seal substantially parallel to the vertical plane that includes the central axes and above the first fitment such that the first fitment is part of a first flexible package separated from a second flexible package of which the second fitment is a part, the second seal comprising a section angled with respect to horizontal to create a second angled side.

16. The method of claim 15, wherein forming a substantially hollow structure from a sheet of flexible material comprises overlapping two ends of the sheet and sealing at least part of the overlapped sheet.

17. The method of claim 15, wherein the flexible package is a plastic bag.

18. The method of claim 15, wherein one or both of the fitments are attached before forming the substantially hollow structure.

19. The method of claim 15, wherein one or both of the fitments are attached after forming the substantially hollow structure.

* * * * *